US008078068B2

(12) United States Patent
Reitz et al.

(10) Patent No.: US 8,078,068 B2
(45) Date of Patent: Dec. 13, 2011

(54) TONER YIELD ANALYSIS FOR MONITOR AND REPLACEMENT OF CONSUMABLES WITHIN A PRINT SYSTEM

(75) Inventors: Jeremy Lee Reitz, Marion, NY (US); Matthew Owen Scrafford, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 428 days.

(21) Appl. No.: 12/472,575

(22) Filed: May 27, 2009

(65) Prior Publication Data

US 2010/0303481 A1 Dec. 2, 2010

(51) Int. Cl.
*G03G 15/08* (2006.01)

(52) U.S. Cl. ..... 399/27; 399/24; 399/30; 399/58

(58) Field of Classification Search ..... 399/9, 24, 399/25, 27–30, 42, 58–61
See application file for complete search history.

(56) References Cited

U.S. PATENT DOCUMENTS 5,422,708 A 6/1995 Morris et al.
5,760,812 A 6/1998 Hopkins
5,905,510 A 5/1999 Hagiwara et al.
6,248,496 B1 6/2001 Galloway et al.
6,603,933 B1 8/2003 Foegelle
7,181,147 B2 * 2/2007 Kinoshita et al. ..... 399/27
7,324,763 B2 1/2008 Pytlik
7,463,838 B2 12/2008 Chan
2003/0123888 A1 * 7/2003 Naito et al. ..... 399/27
2005/0265738 A1 * 12/2005 Ogata ..... 399/27
2006/0245770 A1 * 11/2006 Choi ..... 399/27
2006/0263105 A1 11/2006 Able et al.

* cited by examiner

*Primary Examiner* — David Porta
*Assistant Examiner* — Jessica L Eley
(74) *Attorney, Agent, or Firm* — Fay Sharpe LLP

(57) ABSTRACT

Systems and methods are described hereinto to provide a notification when a predetermined event occurs that is related to a consumable. A print engine outputs hard copies based on electronically received data. One or more toner cartridges that are utilized by the print engine to place toner onto a hard copy substrate. A meter monitors and provides a level of remaining toner for each of the one or more cartridges. A yield component receives level data from each meter to compare to an expected yield and an expected grams per impression, wherein if the expected yield and/or the expected grams per impression are outside of a predetermined threshold, a signal is output.

20 Claims, 10 Drawing Sheets

Base Meter Read = 1/10 1PM Count = 10
Base Meter Supply = 1/10 1PM Count = 27,000
Max Marker Capacity = 30000
Expected Yield = 10000 @ 5% Coverage

400

| Date and Time | Total Impression | Imp Hours | Total Grams | Total Gram Hours | Imp / Hour | Grams / Hour | Adj. Imp | Adj. Grams | Max Gram Capacity | Expected Grams / Imp | Actual Grams / Imp | Expected Yield | Calculated Yield |
|---|---|---|---|---|---|---|---|---|---|---|---|---|---|
| Date and Time | | | | | | | | | | | | | |
| MR 1/12 2PM<br>MS 1/12 5PM | 40 | 49 | 2000 | 52 | .81 | 38.46 | 40 | 1885 | 30000 | 3 | 47 | 10000 | 638 |
| MR 1/13 12PM<br>MS 1/13 1PM | 90 | 72 | 7000 | 71 | 1.25 | 98.59 | 89 | 7000 | 30000 | 3 | 79 | 10000 | 380 |
| MR 1/14 2PM<br>MS 1/14 5PM | 115 | 97 | 12000 | 100 | 1.18 | 120 | 115 | 11640 | 30000 | 3 | 101 | 10000 | 297 |

FIG. 4

600

Base Meter Read = 1/10 1PM Count = 10
Base Yellow Ink Stick Count = 1/10 1PM Count = 2
Expected Yield = 10000 @ 5% Coverage

| Date | Total Impression | Total Sticks | Expected Yield | Calculated Yield |
|---|---|---|---|---|
| MR 1/12 2PM | 23000 | 2 | 10000 | - |
| MR 1/13 12PM | 27000 | 2 | 10000 | - |
| MR 1/14 2PM | 34000 | 3 | 10000 | 11333 |

FIG. 6

800

Base Meter Read = 1/10 1PM Count = 10000
First Yellow Re-order Point = 1/10 1PM Quantity = 1
Expected Yield = 10000 @ 5% Coverage
Re-order Point Assumption = 20% Remaining Yield

| Re-order Date | Current Impression Count | Total Quantity Ordered | Expected Yield | Calculated Yield |
|---|---|---|---|---|
| 1R1 1/1 9AM | 10000 | 1 | - | 17000 |
| 1R 1/12 2PM | 15000 | 2 | 20000 | 14500 |
| 1R 1/31 6PM | 27000 | 3 | 30000 | 12000 |
| 1R 2/14 11AM | 34000 | 5 | 50000 | - |

FIG. 8

TONER YIELD ANALYSIS FOR MONITOR AND REPLACEMENT OF CONSUMABLES WITHIN A PRINT SYSTEM

BACKGROUND

The present exemplary embodiments broadly relate to systems and methods to order consumables for use within print operations. In one particular application, orders are placed to support a just-in-time system as predefined yield thresholds are met. It is to be appreciated, however, that the present exemplary embodiments are also amenable to other like applications.

Conventional print systems employ multiple marking engines to provide high print outputs by distributing a print job among a plurality of marking engines. These systems may include several black, full color, and/or custom color marking engines for printing of selected pages within a print job. Each marking engine can have a number of components that can be regarded as consumables, since they are designed to be consumed or worn out and replaced at intervals during the normal lifetime of the printing system. Consumables for xerographic marking engines typically include toner cartridges, photoreceptor belts, and the like.

Ink jet printers often have ink cartridges can contain ink in liquid or solid (stick) form. In a color marking engine for a xerographic process, for example, there may be four toner cartridges, one for each of the cyan, magenta, yellow, and black separations of the image. As the number of marking engines in a printing system increases, the number of times any one of the toner cartridges needs to be replaced in a given time period increases. For example, in a printing system with four process color marking engines, there may be sixteen toner cartridges.

Even where each marking engine prints an approximately equal number of pages, differences in the content of the pages and individual attributes of the marking engines can result in unequal consumption of the marking materials. For example, a page with a large proportion of solid black or other color will consume more toner than a page which is light grey or has only a small area of coverage. Since the cartridges tend to run out at different times, it is difficult for the operator to set up a replacement schedule for simultaneous replacement of cartridges or other consumable items without resulting in considerable wastage of the consumables.

This problem is exacerbated when determining the order point for supplies within a just-in-time inventory system. This is due to several factors, including knowing the current inventory supply at the customer site and the current toner levels on the device. Even though some devices will report the current level of the toner in the device, it is not an accurate predictive measure of when to reorder due to the variance in the yield from cartridge to cartridge. What are needed are systems and methods to provide more accurate predictive models for consumable supply ordering.

BRIEF DESCRIPTION

In one aspect, a system provides a notification when a predetermined event occurs that is related to a consumable. A print engine outputs hard copies based on electronically received data. One or more toner cartridges are utilized by the print engine to place toner onto a hard copy substrate. A meter monitors and provides a level of remaining toner for each of the one or more cartridges. A yield component receives level data from each meter to compare to an expected yield and an expected grams per impression. The expected yield is equivalent to a rated coverage percentage divided by an average coverage percentage times the yield. The expected grams per impression is equal to a maximum marker capacity divided by the expected yield calculated. If the expected yield and/or the expected grams per impression are outside of a predetermined threshold, a signal is output.

In another aspect, a computer implemented method is used to calculate an actual yield of a consumable within a device. An impressions count is received from a black and white meter and a color meter for the device calculating the total impressions for a black toner and a color toner within the device. The total grams of toner used by the device is calculated. The adjusted grams of toner is calculated based on the time difference between the meter and marker reading. The adjusted total impressions is calculated based on the time difference between the meter and marker reading. The actual grams per impression is calculated based at least in part upon the adjusted grams of toner and the adjusted total impressions. The actual yield is calculated based at least in part upon the actual grams per impression and the expected yield. An output is sent if the actual yield is less than a predetermined threshold.

In yet another aspect, a computer implemented method is used to calculate the yield per stick for a device. A total impressions count and an expected yield per stick are received for a device. An ink stick count value is received for the device and the yield per stick for the device is calculated if there is a change in the stick count value. The yield per stick value is compared to an predetermined value and a signal is output if a difference between the yield per stick value is greater than a predetermined threshold.

BRIEF DESCRIPTION OF THE DRAWINGS

FIG. 4 illustrates an exemplary data set for a device capable of reporting maximum toner capacity and a current toner level, in accordance with an exemplary embodiment.

FIG. 6 illustrates an exemplary data set for a device capable of reporting overall ink stick count, in accordance with an exemplary embodiment.

FIG. 8 illustrates an exemplary data set for a device incapable of output wherein yield is calculated based on the last supply order and impression count, in accordance with an exemplary embodiment.

DETAILED DESCRIPTION

Figure 1:
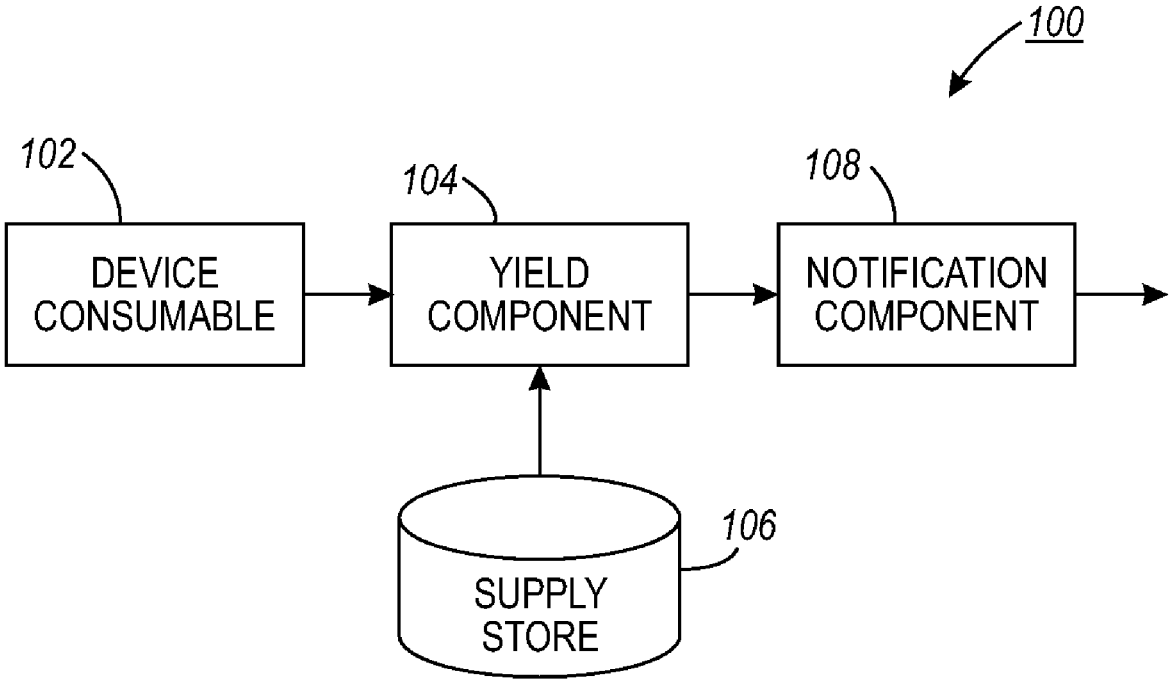
FIG. 1 is a system to determine a consumable yield to facilitate ordering of replacement consumables in view of a current supply store, in accordance with an exemplary embodiment.

FIG. 1 illustrates a system 100 to provide information in substantially real time related to performance of a device consumable 102. In one aspect, the device consumable 102 can be a toner cartridge that requires replacement of toner contained therein. In another aspect, the device consumable 102 provides a yield that is outside of a predetermined window and is therefore indicative of device failure. In either case, downtime of a print system can be reduced by receiving information which is continuously updated.

A yield component 104 receives information from the device consumable 102 related to one or more metrics. Such metrics can include the amount of toner used, the number of impressions printed, the number of hours the device consumable is in use, etc. This information can be processed via an algorithm to ascertain performance of the device consumable 102 in view of predetermined standards associated therewith. The yield component 104 can further receive information from a supply store 106 related to on-hand inventory of the device consumable 102.

Current consumable levels and/or performance of the consumable in view of current inventory provided by the supply store 106 can allow the yield component 104 to determine if action needs to be taken related to the device consumable 102. In one instance, the yield component 104 can determine if toner needs to be ordered to replenish the device consumable 102. In another instance, the yield component 104 can determine if maintenance is required with regard to the device consumable 102. If notification is required, the yield component 104 can output a signal to a notification component 108 to provide appropriate attention to the device consumable 102.

The notification component 108 can output a signal to place an order for a particular model of device consumable and appropriate as it relates to an appropriate device. In this example, the notification component 108 can interface with a processing component (not shown) that is located either locally or remotely from the system 100. In one example, the notification component 108 outputs a signal to a supplier to place an order for the appropriate consumable. In another example, the notification component 108 is coupled to an alert system (not shown) that can alert maintenance personnel that attention is required with regard to the device consumable 102 and/or the device wherein the device consumable 102 is located. In this manner, intelligent data gathering can be utilized to optimize production of a print system by minimizing down time associated therewith.

Figure 2:
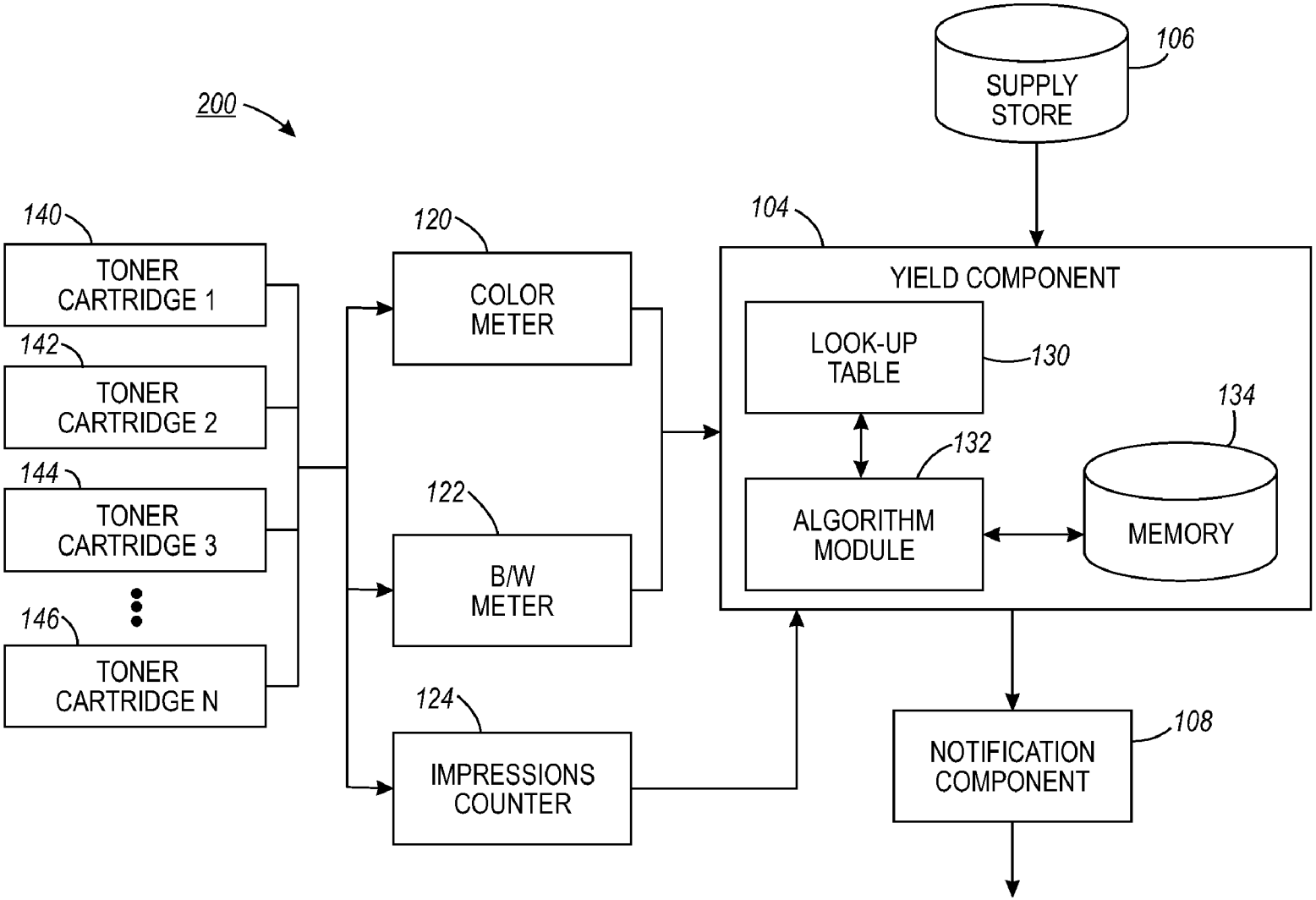
FIG. 2 is a system to facilitate ordering of replacement toner for a plurality of toner cartridges, in accordance with an exemplary embodiment.

FIG. 2 illustrates a system 200 to provide appropriate attention to a plurality of toner cartridges based upon the amount of toner used per cartridge and the number of impressions created. A color meter 120 and a black and white meter 122 provide information related to the amount of toner remaining for each cartridge 140, 142, 144 and 146. An impressions counter 124 tracks the number of impressions created by the toner cartridges 140-146. As utilized herein, an impression can relate to the creation of a hard copy on a single printed page. Such printed page sizes can include A4, 8.5×11, 11×17, etc. In addition, each impression can utilize one or more toner cartridges 140-146 for creation thereof. Thus, one document may utilize only a black toner cartridge whereas another document requires a black toner cartridge and a color cartridge. The yield component 104 can determine if attention is required based on the information provided by the color meter 120, the black and white meter 122 and the impressions counter 124 as well as the supply store 106, which identifies on-hand quantities of the required consumable. The notification component 108 is alerted via the yield component 104 if attention to the toner cartridges 140-146 is necessary.

The yield component 104 includes a lookup table 130, an algorithm module 132 and a memory 134. Information received by the yield component 104 can include specific information related to each toner cartridge 140-146 including make and model of the cartridge, type of cartridge, etc. This information can be provided to the lookup table 130 to identify specific data related thereto such as a maximum capacity of each toner cartridge 140-146, a rated coverage percentage, an average coverage percentage, an expected yield, etc.

The algorithm module 132 can interface with the lookup table 130 in order to determine an actual yield and/or an actual amount of toner utilized per impression. The memory 134 stores previous readings for the color meter 120, the black and white meter 122, the previous number of impressions from the impressions counter 124, and previous outputs to the notification component 108. Yield can be defined as the amount of toner used per impression over a given period of time. By comparing the actual yield with an expected yield (e.g., provided via a rated coverage percentage, an average coverage percentage, and/or a maximum capacity value for each cartridge), the algorithm module 132 can determine if a cartridge requires replacement toner and/or maintenance attention.

Figure 3:
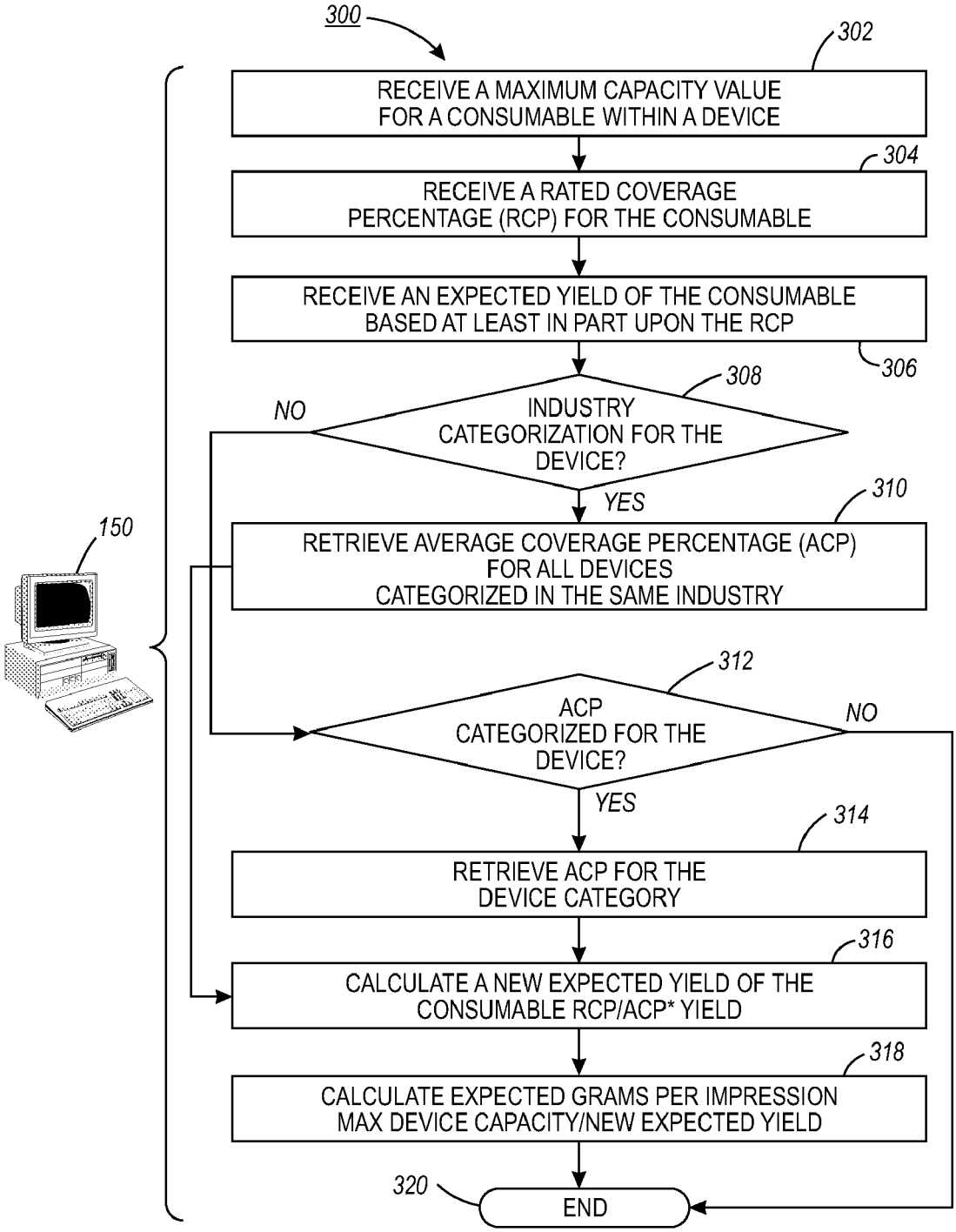
FIG. 3 is a method to calculate an expected yield and expected grams per impression for a consumable, in accordance with an exemplary embodiment

FIG. 3 illustrates a method 300 to calculate expected yield and grams per impression for a consumable (such as the toner cartridges 140-146). At reference numeral 302, a maximum capacity value is received for a consumable within a device, which is the maximum amount of consumable that can be stored within a device and/or a component. In one example, the consumable is a toner stored within a toner cartridge, wherein the quantity of toner is measured in grams.

At 304, a rated coverage percentage (RCP) is received for the consumable. The rated coverage percentage is a predetermined coverage percentage assigned to the consumable relative to a standardized paper size. In one example, a rated coverage percentage is five percent, meaning the entire page is covered with toner and implies a basic type with no bold characters, no graphics and no pictures. At 306, an expected yield is received that is based at least in part upon the RCP from 304. An expected yield for a CMYK toner cartridge can be twenty to thirty-five percent based on a five to seven percent rated coverage percentage per color. In this manner, a user can predict the number of impressions to expect based on the expected yield and RCP for each consumable. This information can facilitate predictive maintenance of the consumable.

At 308, there is a determination whether an industry categorization exists for the device. If the device is categorized in a certain industry, at 310, an average coverage percentage (ACP) is retrieved for all devices categorized in the industry. If there is no industry categorization for the device, at 312, a determination is made whether there is an ACP categorization for the device. If so, at 314, an ACP is retrieved for the device category. If not, the method 300 ends at 320. Once the ACP is retrieved either at 310 or 314, a new expected yield of the consumable is calculated at 316. In one example, the expected yield is equal to $$(RCP)/\text{by}\ (ACP)\times(\text{yield [received at 306]}) \quad (1)$$

At 318, an expected grams per impression value is calculated as equal to (maximum marker capacity [received at 302])/(new expected yield [determined at 316]) (2)

At 320 the method 300 ends.

FIGS. 4, 6, and 8 illustrate data sets 400, 600, and 800 related to three disparate order yield models for a device. Substantially any device consumable can use one of these three models. Each model utilizes an algorithm, described in FIGS. 5, 7, and 9 respectively, that is relevant to the consumable usage information available. The model data set 400, for example, is based upon more complete information about consumable usage than that of 600. Using one of these models can result in a more accurate calculated order yield for any given device over time. The order yield can be indicative of appropriate times to restock a consumable and/or to address maintenance concerns related to consumable functionality.

Turning now to FIG. 4, which illustrates a data set 400 for an exemplary order yield model. This order yield model is utilized with a device capable of reporting a maximum toner capacity, a current toner level, a number of total impressions, and total grams of toner used by the consumable. In this example, on January $10^{th}$ at 1:00 p.m., an initial base meter reading indicates 10 grams of toner. The base marker supply at the same time and date indicates that 27,000 grams of toner are remaining for this particular consumable. The device has a maximum marker capacity of 30,000 grams and an expected yield of 10,000 grams at five percent coverage. As readings are not taken on a regular basis and/or via the same means over time, the meter read and marker supply values are normalized to a time metric.

The level of toner within a toner cartridge can be determined via either a raw meter reading or a marker supply reading. In one example, the number of impressions, impression hours, total grams and total gram hours are retrieved from either the meter reading or marker supply reading. Each meter reading is paired with a marker supply reading taken on the same day to provide a unitary data set. This data is adjusted to compensate for any time lapse between a marker supply reading and a meter reading. A first row under the date and time provides an exemplary data set. It is to be appreciated that the second and third rows provide further exemplary data related to disparate days, as indicated.

In this example, a meter reading is taken on January $12^{th}$ at 2:00 p.m. and a marker supply reading is taken three hours later on the same day. The impressions and grams of toner used can be adjusted over time and output in the Adjusted Impressions and Adjusted Grams columns respectively. In this case, 40 total impressions divided by 49 impression hours provide 0.81 impressions per hour in the fifth column. As 2,000 grams of toner remain with 52 total gram hours; 38.46 grams of toner are utilized per hour.

An algorithm can be utilized to determine an adjusted impressions value and an adjusted grams value. Such values can be utilized with a maximum gram capacity to calculate an actual yield. In this case, the maximum capacity of 30,000 grams is divided by 47 actual grams per impression to provide an actual calculated yield of 638 impressions. The calculated yield can be compared to an expected yield to determine whether further action is to be taken or whether to continue with monitoring of the consumable levels.

This information can allow one to predict the toner level over a set period of time based on known impressions per hour usage. In one example, future orders can be predicted to restock the toner. In another example, if the calculated yield is less than expected for a particular consumable it can be indicative of component failure or toner leakage. In either case, personnel can be notified to replenish the supply of the toner and/or address any maintenance concerns.

Figure 5:
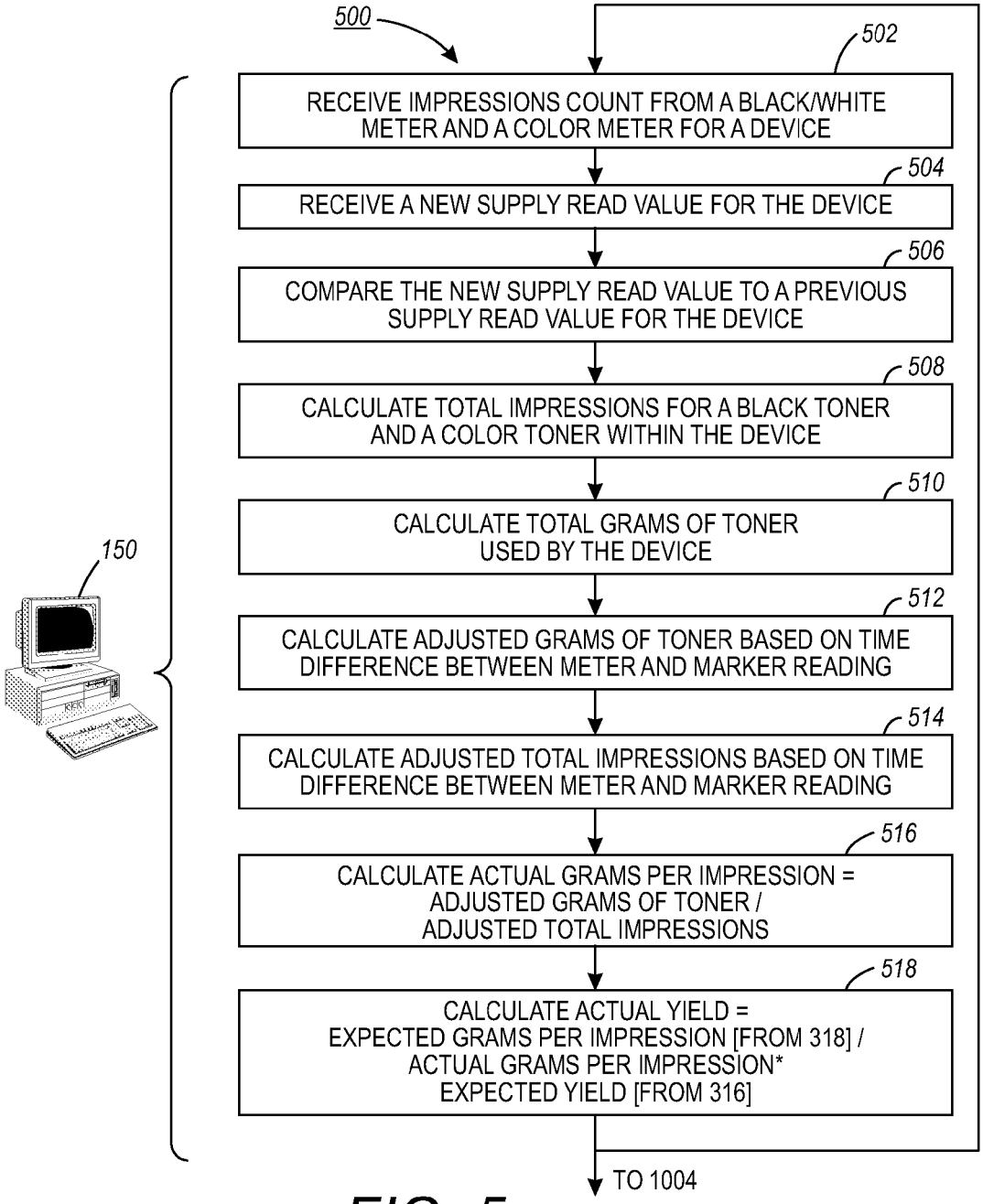
FIG. 5 illustrates a method to calculate an actual yield and grams per impression for a device capable of reporting maximum toner capacity and current toner level, in accordance with an exemplary embodiment.

FIG. 5 illustrates a method 500 to calculate an actual yield for a print operation. At reference numeral 502, an impressions count is received from a black and white meter and a color meter for a device. At 504, a new marker supply read value is received for the device. The marker supply read value can vary from the meter reading as it is generally taken at a disparate point in time. At 506, the marker supply read value is compared to a previous marker supply read value for the device. At 508, a total number of impressions for a black toner and color toner within the device are calculated. The total impressions value for the black toner is equal to a sum of the impressions received from the black and white meter with the impressions received from the color impressions meter. The total impressions value for the color toner is equivalent to the color impressions meter value. Accordingly, the total impressions is equal to:

(previous total impressions)+((new meter read)−(previous meter read)) (3)

At 510, the total grams of toner used by the device is calculated. If the marker supply or read value is less than the previous marker supply read value, then the total grams is equal to (previous total grams)+(maximum capacity−previous read value)+(new read value [from 504]) (4)

If the marker supply read value is not less than the previous marker supply read value, then total grams is equal to (previous total grams)+(new read value)−(previous read value) (5)

At 512, the adjusted grams of toner value is calculated based on the time difference between the meter and marker readings. If the total grams per hour is greater than the impression hours, the adjusted grams value is equal to (total grams)−((total grams per hour)−(impression hours)×(grams per hour)) (6)

If the total grams per hour is equal to or less than the impression hours, the adjusted grams value is equal to the total grams calculated at 510. At 514, an adjusted total impressions value is calculated based on the time difference between the meter reading and marker supply readings. If the impressions per hour are greater than the total grams per hour, then the adjusted impressions value is equal to (total impressions)−((impression hours)−(total grams per hour)×(impression hours)) (7)

If the impressions per hour are less than or equal to the total grams per hour, the adjusted impression is equal to the total impressions calculated at 508. At 516, the actual grams per impression is calculated as (adjusted grams [from 512])/(adjusted impressions [from 514]) (8)

At 518, the actual yield is calculated as (expected grams per impression [from 318])/((actual grams per impression [from 516])×(expected yield [from 318])) (9)

The method 500 continues to step 1004 of method 1000 below to determine whether action is required based on the actual yield of the consumable calculated.

FIG. 6 illustrates an exemplary table 600 that shows a data set related to a second exemplary device capable of reporting an overall ink stick count. It is to be appreciated that the data for the device set forth in table 600 is much less granular than the table 400 discussed above as less information is available from the consumable under monitor. In particular, the device consumable can only provide the total sticks utilized and the total number of impressions associated therewith. Accordingly, changes in stick ink count value are utilized to determine a calculated yield for a consumable.

A base meter reading at 1:00 p.m. on January $10^{th}$ is 10 with a yellow ink stick count of 2 at the same time and date. An expected yield of 10,000 impressions at 5 percent coverage is provided. As set forth by the table 600, there is no calculated yield until a stick count value changes. Thus, a calculated yield at 2:00 p.m. on January $12^{th}$ and 12:00 p.m. on January $13^{th}$ is unavailable as the stick count is equal to 2 for both times.

The stick count value changes, however, at 2:00 p.m. on January $14^{th}$ when a meter reading is taken. At that time, a total impression count of 34,000 is read with a total stick count of 3. The yield is the impression count (34,000) divided by the stick count to equal 11,333 impressions per stick. As noted above, the calculated yield can be compared to the expected yield (e.g., 10,000 impressions) to determine if further action is to be taken.

Figure 7:
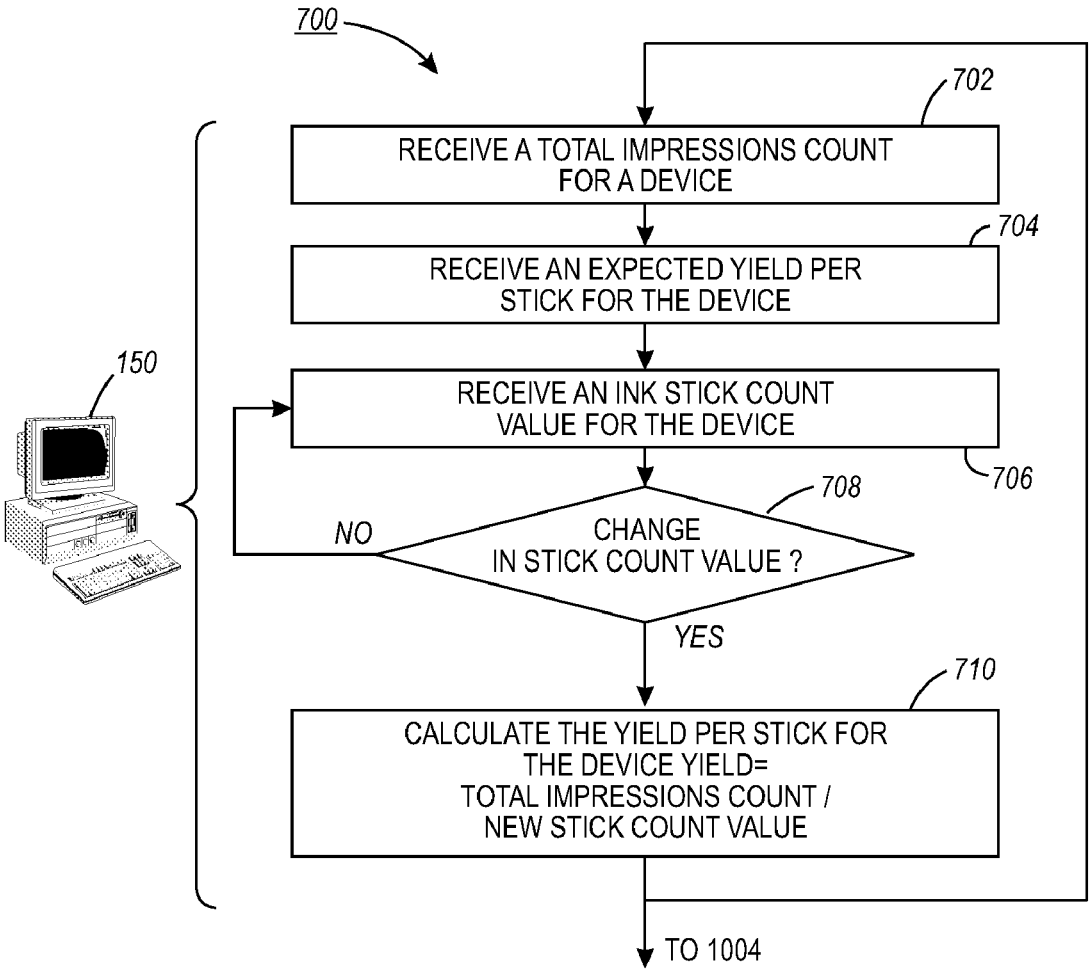
FIG. 7 illustrates a method to calculate actual yield of a device capable of reporting overall ink stick count, in accordance with an exemplary embodiment.

FIG. 7 illustrates an exemplary method 700 that can be utilized to provide a data set as depicted in the table 600 above. At 702, a total impressions count is received for a device and, at 704, an expected yield per stick is also received for the device. The expected yield per stick can be based on values related to particular industries and usage associated therewith. In one example, the expected yield per stick is 10,000 impressions. An ink stick count value is received at 706 to provide the number of ink sticks utilized up to the time the reading is taken.

At 708, a determination is made as to whether a change in the stick count value has occurred. If not, the method reverts to 706 to receive a stick value at a disparate time. If there is a change in stick value, however, at 710 the yield per stick for the device can be calculated. It is to be appreciated that a change in stick count value is required in order for a yield per stick calculation to occur. At 710 the yield per stick value equals $$\text{(total impressions count [received at 702])/(new stick count value [received at 706])} \quad (10)$$

The method 700 reverts to step 702 to continue receiving a total impressions count, an expected yield per stick, and an ink stick count value for the device in order to determine if a yield per stick calculation can be calculated. In addition, the method 700 outputs to step 1004 for use in a preventive maintenance and reordering scenario as indicated above.

FIG. 8 illustrates a table 800 that includes a data set related to a third exemplary consumable, wherein the device and/or the consumable contained therein is incapable of outputting information related to the consumable level or use. Accordingly, the data utilized is solely relegated to the quantity of consumable ordered and the current impression count. The expected yield is related to the total quantity of sticks ordered wherein a predetermined (e.g., 10,000) impression per stick yield is expected. The current impression count and the total quantity ordered can be utilized to provide a calculated yield value for each time instance. As each cartridge is utilized to a predetermined level (e.g., 80%) before an order is placed, the calculated yield can be based upon a current calculated yield summed with an impressions count between orders. This summed value is divided by a total quantity of sticks ordered to create the new calculated yield.

Figure 9:
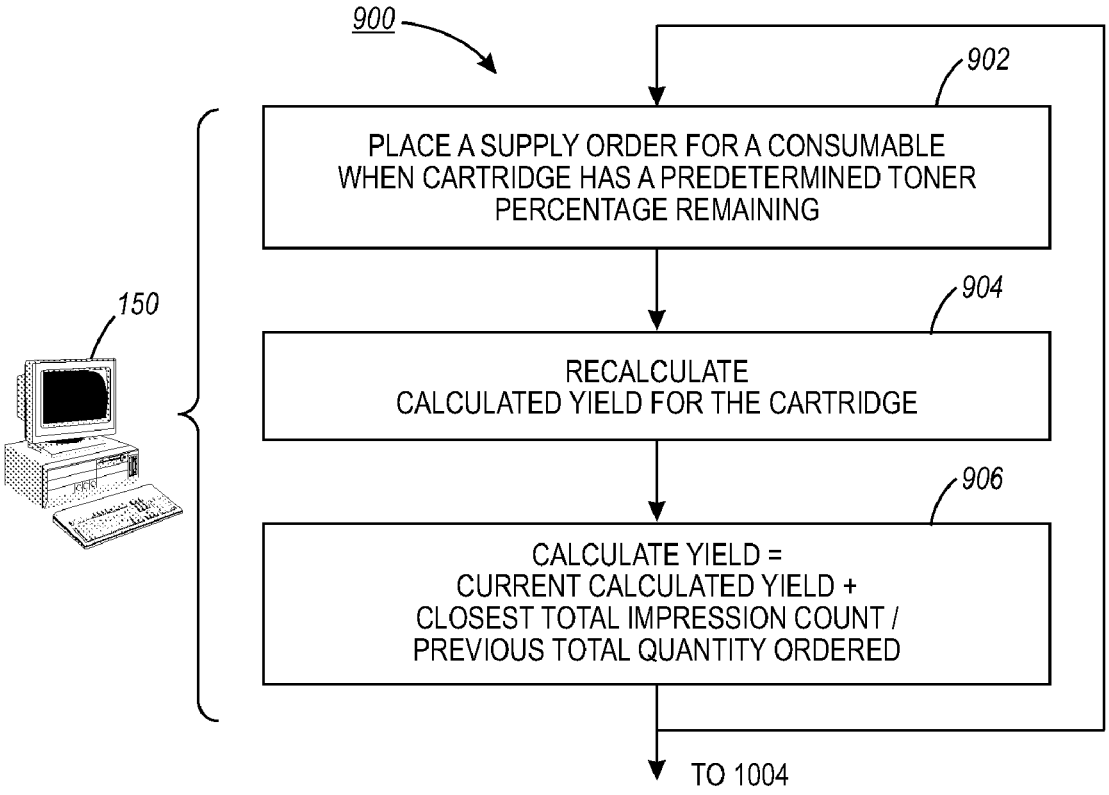
FIG. 9 illustrates a method to calculate actual yield for a device with no data output, in accordance with an exemplary embodiment.

FIG. 9 illustrates a method 900 to calculate a yield for a consumable that does not provide any quantity information. Therefore, the yield is calculated based upon last supply order and volume. At 902, a supply order for a consumable placed when a cartridge has a predetermined toner percentage remaining. In one example, a toner is utilized until it has 20% capacity remaining, at which point an order for additional toners or sticks is placed to ensure that production is not interrupted. At 904, based upon an order placement at 902, the calculated yield for the cartridge is recalculated. At 906, the calculated yield is equal to $$\text{(current calculated yield)+(impressions between orders)/(cartridges ordered)} \quad (11)$$

Figure 10:
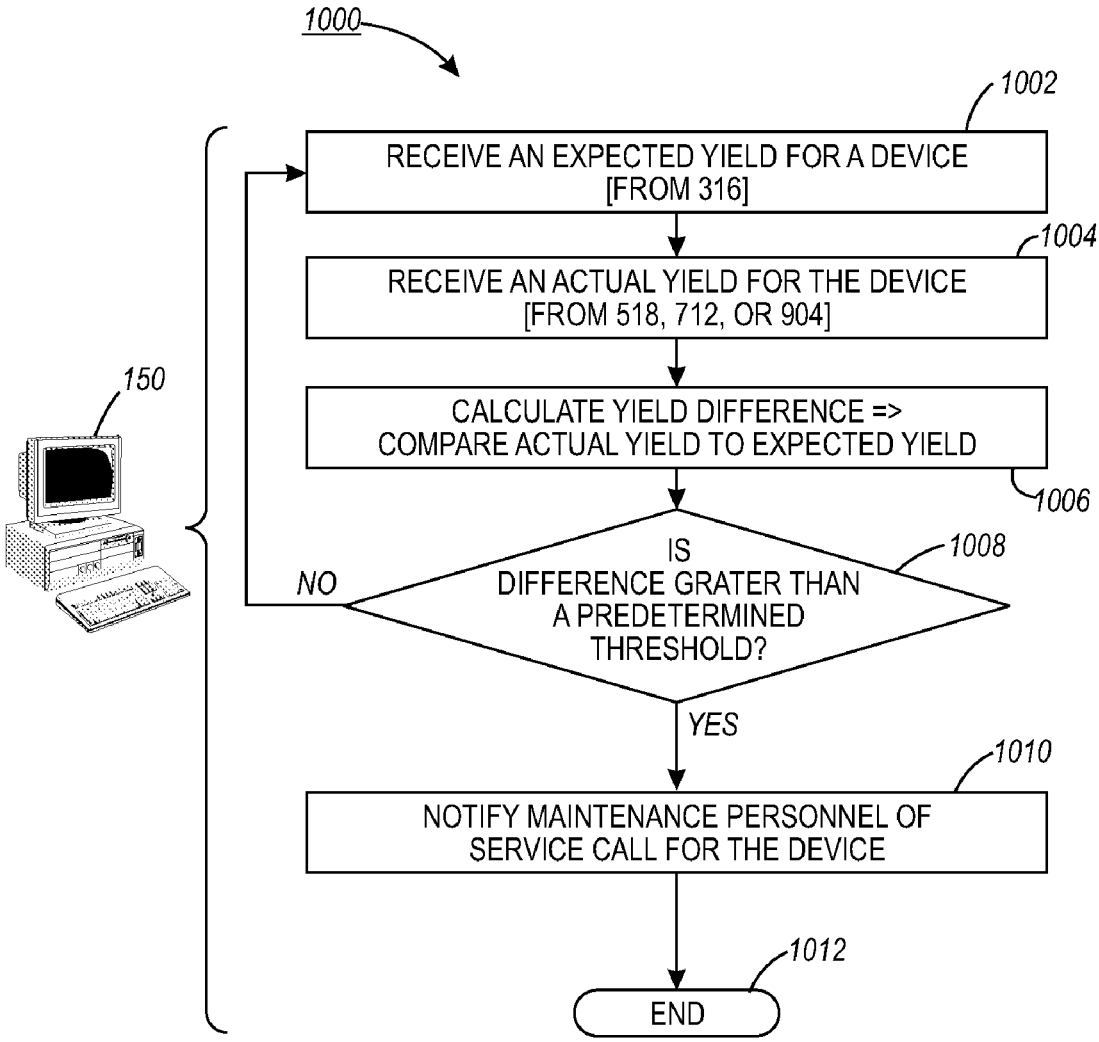
FIG. 10 illustrates a method to facilitate a predictive maintenance schedule based on an expected and an actual yield for a device, in accordance with an exemplary embodiment.

FIG. 10 illustrates a method 1000 to facilitate predictive maintenance for a device relative to consumables contained therein. At 1002, an expected yield for a device is received (e.g. from step 316). The expected yield is the number of impressions expected for a given consumable. At 1004, an actual yield for the device is received (e.g. from steps 518, 712, and/or 906 above). The actual yield for the device is the number of impressions produced per consumable.

At 1006, the difference in the actual yield and the expected yield is calculated. At 1008, if the difference is greater than a predetermined threshold, maintenance personnel is notified for a service call for the device at 1010. If the difference is not greater than a predetermined threshold, the method reverts back to step 1002 to receive expected and actual yields for comparison in a continuous fashion. At 1012 the method ends.

A computer 150 illustrates one possible hardware configuration to support the systems and methods described herein, including the methods 300, 500, 700, 900, and 1000 above. It is to be appreciated that although a standalone architecture is illustrated, that any suitable computing environment can be employed in accordance with the present embodiments. For example, computing architectures including, but not limited to, stand alone, multiprocessor, distributed, client/server, minicomputer, mainframe, supercomputer, digital and analog can be employed in accordance with the present embodiment.

The computer 150 can include a processing unit (not shown), a system memory (not shown), and a system bus (not shown) that couples various system components including the system memory to the processing unit. The processing unit can be any of various commercially available processors. Dual microprocessors and other multi-processor architectures also can be used as the processing unit.

The system bus can be any of several types of bus structure including a memory bus or memory controller, a peripheral bus, and a local bus using any of a variety of commercially available bus architectures. The computer memory includes read only memory (ROM) and random access memory (RAM). A basic input/output system (BIOS), containing the basic routines that help to transfer information between elements within the computer, such as during start-up, is stored in ROM.

The computer 150 can further include a hard disk drive, a magnetic disk drive, e.g., to read from or write to a removable disk, and an optical disk drive, e.g., for reading a CD-ROM disk or to read from or write to other optical media. The computer 150 typically includes at least some form of computer readable media. Computer readable media can be any available media that can be accessed by the computer. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other magnetic storage devices, or any other medium which can be used to store the desired information and which can be accessed by the computer.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above can also be included within the scope of computer readable media.

A number of program modules may be stored in the drives and RAM, including an operating system, one or more application programs, other program modules, and program non-interrupt data. The operating system in the computer 150 can be any of a number of commercially available operating systems.

A user may enter commands and information into the computer through a keyboard (not shown) and a pointing device (not shown), such as a mouse. Other input devices (not shown) may include a microphone, an IR remote control, a joystick, a game pad, a satellite dish, a scanner, or the like. These and other input devices are often connected to the processing unit through a serial port interface (not shown) that is coupled to the system bus, but may be connected by other interfaces, such as a parallel port, a game port, a universal serial bus ("USB"), an IR interface, etc.

A monitor, or other type of display device, is also connected to the system bus via an interface, such as a video adapter (not shown). In addition to the monitor, a computer typically includes other peripheral output devices (not shown), such as speakers, printers etc. The monitor can be employed with the computer 150 to present data that is electronically received from one or more disparate sources. For example, the monitor can be an LCD, plasma, CRT, etc. type that presents data electronically. Alternatively or in addition, the monitor can display received data in a hard copy format such as a printer, facsimile, plotter etc. The monitor can present data in any color and can receive data from the computer 150 via any wireless or hard wire protocol and/or standard.

The computer 150 can operate in a networked environment using logical and/or physical connections to one or more remote computers, such as a remote computer(s). The remote computer(s) can be a workstation, a server computer, a router, a personal computer, microprocessor based entertainment appliance, a peer device or other common network node, and typically includes many or all of the elements described relative to the computer. The logical connections depicted include a local area network (LAN) and a wide area network (WAN). Such networking environments are commonplace in offices, enterprise-wide computer networks, intranets and the Internet.

When used in a LAN networking environment, the computer is connected to the local network through a network interface or adapter. When used in a WAN networking environment, the computer typically includes a modem, or is connected to a communications server on the LAN, or has other means for establishing communications over the WAN, such as the Internet. In a networked environment, program modules depicted relative to the computer, or portions thereof, may be stored in the remote memory storage device. It will be appreciated that network connections described herein are exemplary and other means of establishing a communications link between the computers may be used.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system that provides a notification when a predetermined event occurs that is related to a consumable, comprising:

a print engine that outputs hard copies based on electronically received data;

one or more toner cartridges that are utilized by the print engine to place toner onto a hard copy substrate;

a meter that monitors and provides a level of remaining toner for each of the one or more cartridges; and, a yield component that receives level data from each meter to compare to an expected yield and an expected grams per impression, the expected yield is equivalent to a rated coverage percentage divided by an average coverage percentage times the yield, the expected grams per impression is equal to a maximum marker capacity divided by the expected yield calculated, wherein if the expected yield and/or the expected grams per impression are outside of a predetermined threshold, a signal is output.

2. The system according to claim 1 wherein the rated coverage percentage is the coverage percentage expected for a particular toner cartridge relative to a particular usage.

3. The system according to claim 1 wherein the average coverage percentage is related to a device categorization within a particular industry or related to the device categorization relative to a particular average coverage percentage.

4. The system according to claim 1 further including an impressions counter that tracks the number of impressions created per cartridge.

5. The system according to claim 1 further including a clock that tracks the time span over which the toner cartridge is utilized.

6. The system according to claim 1 wherein the yield component further includes a look-up table that provides at least one of the following for each toner cartridge: a maximum capacity value, a rated coverage percentage, an average coverage percentage, and, an expected yield.

7. The system according to claim 6 further including a memory that includes at least one of a previous output value, a previous count value, and a previous meter level.

8. The system according to claim 7 further including an algorithm module that receives information from the meter, the impressions counter, the look-up table, and the memory to calculate an actual yield, wherein the actual yield is compared to the expected yield to determine if a toner order is placed and/or a service call notification is sent to a maintenance personnel.

9. The system according to claim 1 further including a supply store that contains a current inventory level of on-hand consumables wherein the yield component will not send an output signal if the supply store is at or above a predetermined threshold.

10. A computer implemented method to calculate an actual yield of a consumable within a device, comprising:

receiving an impressions count from a black and white meter and a color meter for a device;

calculating the total impressions for a black toner and a color toner within the device;

calculating the total grams of toner used by the device;

calculating adjusted grams of toner based on the time difference between the meter and marker reading;

calculating adjusted total impressions based on the time difference between the meter and marker reading;

calculating the actual grams per impression based at least in part upon the adjusted grams of toner and the adjusted total impressions;

calculating the actual yield based at least in part upon the actual grams per impression and the expected yield; and sending an output if the actual yield is less than a predetermined threshold.

11. The method according to claim 10, further including:

receiving an expected yield for a device;

calculating the difference between the expected yield and the actual yield; and, sending an output signal to request a service call or an order placement if the difference is greater than a predetermined threshold.

12. The method according to claim 10 further including receiving a new supply read for the device; and comparing the new supply read value to a previous supply read value for the device.

13. The method according to claim 12 wherein the total impressions is equal to the previous total impressions value plus a new read value minus the previous read value.

14. The method according to claim 10 wherein the total grams of toner used by the device is equal to the previous total grams plus (new read minus previous read) if the marker supply read is greater than or equal to the previous marker supply read, and equal to the previous total grams plus (the maximum capacity minus the previous read) plus the new read if the marker supply read is less than the previous marker supply read.

15. The method according to claim 10 wherein the adjusted grams of toner is equal to the total grams if the total grams per hour is less than or equal to the impression hours.

16. The method according to claim 10 wherein the adjusted grams of toner is equal to the total grams minus ((total grams per hour minus impression hours) times (grams per hour) if the total grams per hour is greater than the impression hours.

17. The method according to claim 10 wherein the adjusted total impression is equal to the total impressions if the impressions per hour are less than or equal to the total grams per hour; and, the adjusted total impression is equal to the total impressions minus ((impression hours minus total grams per hour) times (impression hours) if the impressions per hour is greater than the total grams per hour.

18. The method according to claim 10 wherein the actual grams per impression is equal to the adjusted grams divided by the adjusted impressions, and the calculated yield is equal to the expected grams per impression divided by the actual grams per impression times the expected yield.

19. A computer implemented method to calculate the yield per stick for a device, comprising:

receiving a total impressions count for a device;

receiving an expected yield per stick for the device;

receiving an ink stick count value for the device;

calculating the yield per stick for the device if there is a change in the stick count value;

comparing the yield per stick value to a predetermined value; and outputting a signal if a difference between the yield per stick value is greater than a predetermined threshold.

20. The method according to claim 19 wherein the yield per stick is equal to the total impressions count divided by the new stick count value.

* * * * *